US005656150A

United States Patent [19]

Reed et al.

[11] Patent Number: 5,656,150

[45] Date of Patent: Aug. 12, 1997

[54] METHOD FOR TREATING THE RADIANT TUBES OF A FIRED HEATER IN A THERMAL CRACKING PROCESS

[75] Inventors: Larry E. Reed; Ronald E. Brown; James P. Degraffenried; Timothy P. Murtha; Gil J. Greenwood; Timothy P. Harper; Mark D. Scharre, all of Bartlesville, Okla.

[73] Assignee: Phillips Petroleum Company, Bartlesville, Okla.

[21] Appl. No.: 296,198

[22] Filed: Aug. 25, 1994

[51] Int. Cl.[6] ..... C10G 9/12; C10G 9/16; C07C 4/04

[52] U.S. Cl. ..... 208/48 R; 208/48 AA; 585/648; 585/950

[58] Field of Search ..... 208/48 R, 48 AA; 585/950, 648

[56] References Cited

U.S. PATENT DOCUMENTS

| | | | |
|---|---|---|---|
| 4,024,051 | 5/1977 | Shell et al. | 208/48 AA |
| 4,404,087 | 9/1983 | Reed et al. | 208/48 AA |
| 4,692,234 | 9/1987 | Porter et al. | 208/48 AA |
| 5,284,994 | 2/1994 | Brown et al. | 585/648 |
| 5,358,626 | 10/1994 | Gandman et al. | 208/48 R |
| 5,435,904 | 7/1995 | Reed et al. | 208/48 AA |
| 5,445,799 | 8/1995 | McCants | 424/146 |
| 5,446,229 | 8/1995 | Taylor et al. | 585/648 |

FOREIGN PATENT DOCUMENTS

| | | | |
|---|---|---|---|
| 0241020 | 4/1987 | European Pat. Off. | C07C 4/04 |

*Primary Examiner*—Glenn A. Caldarola
*Assistant Examiner*—Bekir L. Yildirim
*Attorney, Agent, or Firm*—Charles W. Stewart

[57] ABSTRACT

A novel method for treating the radiant tubes of a fired pyrolysis heater with an antifoulant composition for inhibiting the formation and deposition of coke thereon. Such novel method includes introducing the antifoulant into the crossover conduit between the convection tubes and radiant tubes of the fired pyrolysis heater.

13 Claims, 1 Drawing Sheet

METHOD FOR TREATING THE RADIANT TUBES OF A FIRED HEATER IN A THERMAL CRACKING PROCESS

The present invention relates to the treatment of the radiant section tubes of a fired pyrolysis heater with an antifoulant for inhibiting the formation and deposition of carbon the surface of such tubes.

In a process for producing an olefin compound, a fluid stream containing a saturated hydrocarbon such as ethane, propane, butane, pentane, naphtha, or mixtures of two or more thereof is fed into a thermal (or pyrolytic) cracking furnace. A diluent fluid such as steam is usually combined with the hydrocarbon feed material being introduced into the cracking furnace.

Within the furnace, the saturated hydrocarbon is converted into an olefinic compound. For example, an ethane stream introduced into the cracking furnace is converted into ethylene and appreciable amounts of other hydrocarbons. A propane stream introduced into the furnace is converted to ethylene and propylene, and appreciable amounts of other hydrocarbons. Similarly, a mixture of saturated hydrocarbons containing ethane, propane, butane, pentane and naphtha is converted to a mixture of olefinic compounds containing ethylene, propylene, butenes, pentenes, and naphthalene. Olefinic compounds are an important class of industrial chemicals. For example, ethylene is a monomer or comonomer for making polyethylene. Other uses of olefinic compounds are well known to those skilled in the art.

As a result of the thermal cracking of a hydrocarbon, the cracked product stream can also contain appreciable quantities of hydrogen, methane, acetylene, carbon monoxide, carbon dioxide, and pyrolytic products other than the olefinic compounds.

Antifoulants have been proposed for use in thermal or pyrolytic cracking processes to inhibit the formation and deposition of coke on the walls of the cracking tubes in the cracking furnace or other metal surfaces associated with such cracking processes. One problem encountered in the treatment of the tubes of a cracking furnace of a pyrolytic cracking process is the inability to properly treat the radiant tubes in which the predominant amount of the cracking reactions take place. In attempts to treat a commercial cracking furnace with an antifoulant composition, it was discovered that the radiant tubes were not being properly treated and, as a result, the material used as the antifoulant composition was not effectively being used as an inhibitor of coke formation.

It is an object of this invention to provide an improved cracking process by providing treatment of the cracking tubes of the radiant section of a cracking furnace with an antifoulant composition for inhibiting the formation and deposition of coke.

The present invention is a method for treating the cracking tubes of the radiant section of a fired pyrolysis heater. The fired pyrolysis heater is any standard fired heater suitable for use as a cracking furnace which includes a convection zone and a radiant zone. Within the convection zone are convection tubes which define a preheating zone and within the radiant zone are radiant tubes which define a cracking zone. Fluid flow communication between the preheating zone and the cracking zone is provided by crossover conduit means. An antifoulant composition is introduced into crossover conduit means and is contacted with the radiant tubes under conditions suitable for the treatment of the radiant tubes.

Other objects and advantages of the invention will be apparent from the description of the invention and the appended claims thereof as well as from the detailed description of the drawing in which:

DETAILED DESCRIPTION

Figure 1:
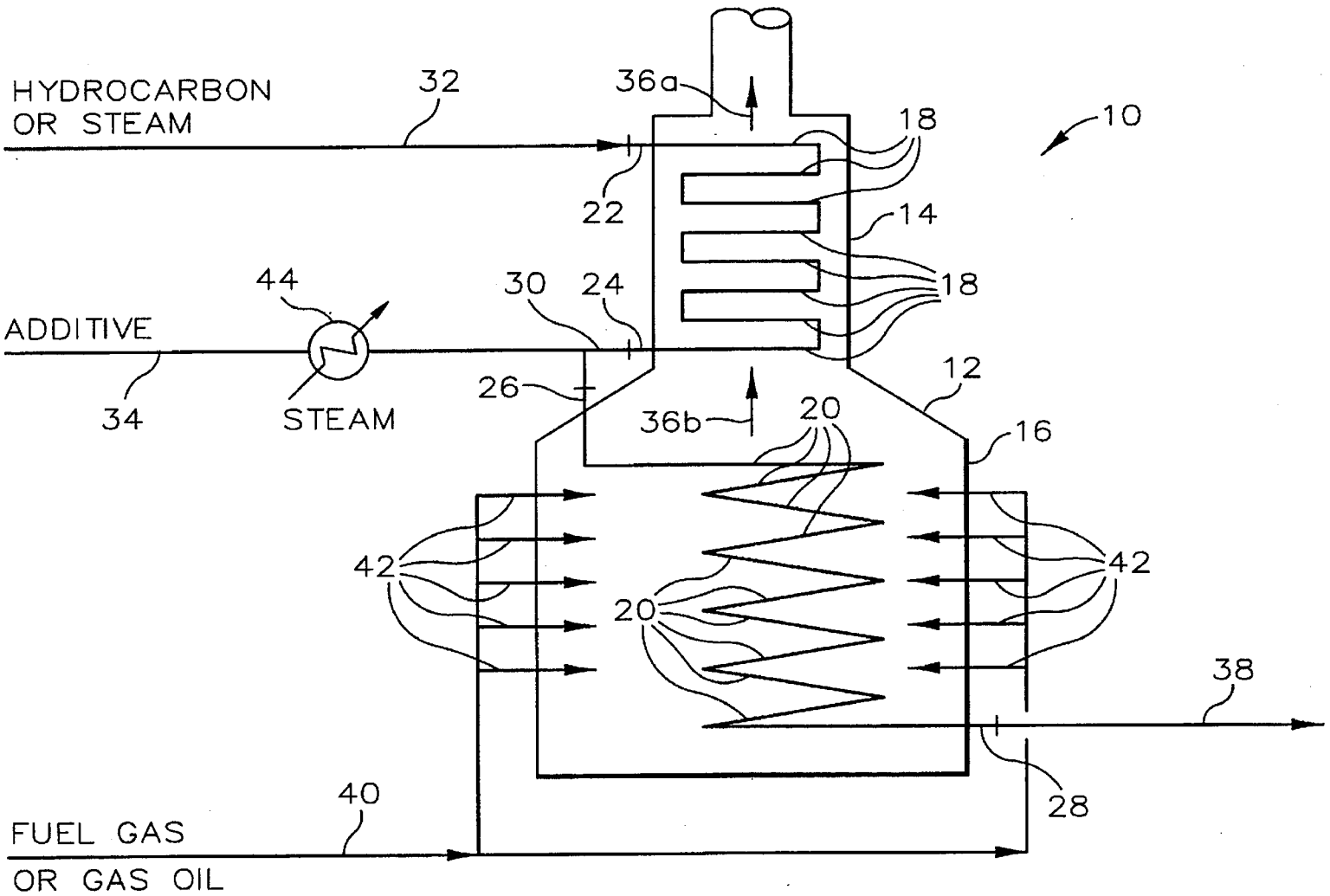
FIG. 1 is a schematic diagram representing the portion of an ethylene cracking process that includes pyrolytic cracking furnace means and illustrates the novel method for treating the radiant tubes of such pyrolytic cracking furnace means.

The process of this invention involves the pyrolytic cracking of hydrocarbons to produce desirable hydrocarbon end-products. A hydrocarbon stream is fed or charged to pyrolytic cracking furnace means wherein the hydrocarbon stream is subjected to a severe, high-temperature environment to produce cracked gases. The hydrocarbon stream can comprise any type of hydrocarbon that is suitable for pyrolytic cracking to olefin compounds. Preferably, however, the hydrocarbon stream can comprise paraffin hydrocarbons selected from the group consisting of ethane, propane, butane, pentane, naphtha, and mixtures of any two or more thereof. Naphtha can generally be described as a complex hydrocarbon mixture having a boiling range of from about 180° F. to about 400° F. as determined by the standard testing methods of the American Society of Testing Materials (ASTM).

As an optional feature of the invention, the hydrocarbon feed being charged to pyrolytic cracking furnace means can be intimately mixed with a diluent prior to entering pyrolytic cracking furnace means. This diluent can serve several positive functions, one of which includes providing desirable reaction conditions within pyrolytic cracking furnace means for producing the desired reactant end-products. The diluent does this by providing for a lower partial pressure of hydrocarbon feed fluid thereby enhancing the cracking reactions necessary for obtaining the desired olefin products while reducing the amount of undesirable reaction products such as hydrogen and methane. Also, the lower partial pressure resulting from the mixture of the diluent fluid helps in minimizing the amount of coke deposits that form on the furnace tubes. While any suitable diluent fluid that provides these benefits can be used, the preferred diluent fluid is steam.

The cracking reactions induced by pyrolytic cracking furnace means can take place at any suitable temperature that will provide the necessary cracking to the desirable end-products or the desired feed conversion. The actual cracking temperature utilized will depend upon the composition of the hydrocarbon feed stream and the desired feed conversion. Generally, the cracking temperature can range upwardly to about 2000° F. or greater depending upon the amount of cracking or conversion desired and the molecular weight of the feedstock being cracked. Preferably, however, the cracking temperature will be in the range of from about 1200° F. to about 1900° F. Most preferably, the cracking temperature can be in the range from 1500° F. to 1800° F.

The cracked hydrocarbon effluent or cracked hydrocarbons or cracked hydrocarbon stream from pyrolytic cracking furnace means will generally be a mixture of hydrocarbons in the gaseous phase. This mixture of gaseous hydrocarbons can comprise not only the desirable olefin compounds, such as ethylene, propylene, butylene, and amylene; but, also, the cracked hydrocarbon stream can contain undesirable contaminating components, which include both oxygenated compounds and acidic compounds, and light ends such as hydrogen, methane and acetylene.

The cracking furnace means of the inventive method can be any suitable thermal cracking furnace known in the art. The various cracking furnaces are well known to those skilled in the art of cracking technology and include fired pyrolysis heaters or fired heaters. The choice of a suitable cracking furnace for use in a cracking process is generally a matter of preference. Such cracking furnaces generally include a convection section defining a convection zone and a radiant section defining a radiant zone. Within the convection zone are convection tubes which define a preheating zone and within the radiant zone are radiant tubes which define a cracking zone. Fluid flow communication between the cracking zone and preheating zone is established by crossover conduit means which is operatively connected to the outlet of the convection tubes and the inlet of the radiant tubes and provides for the conveyance of fluid from the convection tubes to the radiant tubes.

A typical fired heater is equipped with burners for burning fuels such as gas oil and natural gas. The burners are installed either in the walls or the floor of the fired heater and release the heat energy required to provide for the necessary cracking temperature within the cracking zone in order to induce cracking reactions therein. The burners are installed in the radiant section of the fired heater where their firing results in the release of energy. The energy transfer from the energy released by the firing of the burners to the fluid within the cracking zone contained in the radiant zone is principally by radiative transfer. The combustion gases released by the firing of the burners pass through the radiant section and then the convection section of the heater. In the convection section, the transmission of energy from the hot combustion gases passing therethrough to the fluid within the preheating zone is principally by convective transfer.

The temperature of the radiant zone will generally be in the range of from about 1500° F. to about 2800° F. Preferably, the temperature in the radiant zone can be in the range from 1600° F. to 2500° F. and, most preferably, it can be from 1800° F. to 2400° F. The temperature of the convection zone will generally be less than about 1600° F. and, preferably, less than 1500° F.

The critical aspect of the inventive method requires the introduction of an antifoulant composition into the crossover conduit which connects the outlet of the convection tubes with the inlet of the radiant tubes. It has been discovered that, in order to properly treat the radiant section tubes of a cracking furnace with an antifoulant composition, it is important to introduce the antifoulant composition into the crossover conduit. Introduction of the antifoulant composition into the crossover conduit assures that the antifoulant compounds decompose therein rather than within the preheating zone so as to properly coat the radiant tubes with the antifoulant decomposition products.

In prior attempts to treat the radiant tubes of a commercial cracking furnace, the antifoulant was introduced into the inlet of the convection section tubes. Unexpectedly, the radiant section tubes, in which most of the cracking of the hydrocarbons occur and where a predominant amount of coke is formed, were not receiving proper treatment so as to be effective in inhibiting coke formation and deposition.

Without wanting to be limited by any particular theory, it is theorized that by first introducing the antifoulant into the convection section tubes, as opposed to the radiant section tubes, a predominant amount of the antifoulant decomposes within the convection section tubes prior to entering the radiant tubes. Thus, the antifoulant does not reach the radiant section tubes which, as a result, are not properly treated by the antifoulant composition.

Because of the problems associated with introducing antifoulant into the convection section tubes of a cracking furnace, to properly treat the radiant section tubes with the antifoulant it is required for the antifoulant to be introduced into the crossover conduit between the radiant section and the convection section of the cracking furnace. By doing this, the distance within the fired heater tubes that the antifoulant must traverse before decomposing and thereby depositing upon the tube surface is minimized.

The antifoulant composition utilized in the inventive method is any material or composition or compound which when properly applied in accordance with this invention to the radiant tubes of a fired pyrolysis heater suitably inhibits the formation and deposition of coke upon the tube surfaces during the thermal cracking operation. Thus, such antifoulant compositions can comprise compounds containing an element selected from the group consisting of phosphorus, aluminum, silicon, gallium, germanium, indium, tin and any combination of two or more thereof. The preferred antifoulant comprises tin and silicon.

Any suitable form of silicon can be utilized in the antifoulant composition comprising tin and silicon. Elemental silicon, inorganic silicon compounds and organic silicon (organosilicon) compounds as well as mixtures of any two or more thereof are suitable sources of silicon. The term "silicon" generally refers to any one of these silicon sources.

Examples of some inorganic silicon compounds that can be used include the halides, nitrides, hydrides, oxides and sulfides of silicon, silicic acids and alkali metal salts thereof. Of the inorganic silicon compounds, those which do not contain halogen are preferred.

Examples of organic silicon compounds that may be used include compounds of the formula

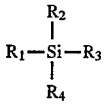

wherein $R_1$, $R_2$, $R_3$, and $R_4$ are selected independently from the group consisting of hydrogen, halogen, hydrocarbyl, and oxyhydrocarbyl and wherein the compound's bonding may be either ionic or covalent. The hydrocarbyl and oxyhydrocarbyl radicals can have from 1–20 carbon atoms which may be substituted with halogen, nitrogen, phosphorus, or sulfur. Exemplary hydrocarbyl radicals are alkyl, alkenyl, cycloalkyl, aryl, and combinations thereof, such as alkylaryl or alkylcycloalkyl. Exemplary oxyhydrocarbyl radicals are alkoxide, phenoxide, carboxylate, ketocarboxylate and diketone (dione). Suitable organic silicon compounds include trimethylsilane, tetramethylsilane, tetraethylsilane, triethylchlorosilane, phenyltrimethylsilane, tetraphenylsilane, ethyltrimethoxysilane, propyltriethoxysilane, dodecyltrihexoxysilane, vinyltriethyoxysilane, tetramethoxyorthosilicate, tetraethoxyorthosilicate, polydimethylsiloxane, polydiethylsiloxane, polydihexylsiloxane, polycyclohexylsiloxane, polydiphenylsiloxane, polyphenylmethylsiloxane, 3-chloropropyltrimethoxysilane, and 3-aminopropyltriethoxysilane. At present hexamethyldisiloxane is preferred.

Organic silicon compounds are particularly preferred because such compounds are soluble in the feed material and in the diluents which are preferred for preparing pretreatment solutions as will be more fully described hereinafter. Also, organic silicon compounds appear to have less of a tendency towards adverse effects on the cracking process than do inorganic silicon compounds.

Any suitable form of tin can be utilized in the antifoulant composition comprising tin and silicon. Elemental tin, inorganic tin compounds and organic tin (organotin) compounds as well as mixtures of any two or more thereof are suitable sources of tin. The term "tin" generally refers to any one of these tin sources.

Examples of some inorganic tin compounds which can be used include tin oxides such as stannous oxide and stannic oxide; tin sulfides such as stannous sulfide and stannic sulfide; tin sulfates such as stannous sulfate and stannic sulfate; stannic acids such as metastannic acid and thiostannic acid; tin halides such as stannous fluoride, stannous chloride, stannous bromide, stannous iodide, stannic fluoride, stannic chloride, stannic bromide and stannic iodide; tin phosphates such as stannic phosphate; tin oxyhalides such as stannous oxychloride and stannic oxychloride; and the like. Of the inorganic tin compounds those which do not contain halogen are preferred as the source of tin.

Examples of some organic tin compounds which can be used include tin carboxylates such as stannous formate, stannous acetate, stannous butyrate, stannous octoate, stannous decanoate, stannous oxalate, stannous benzoate, and stannous cyclohexanecarboxylate; tin thiocarboxylates such as stannous thioacetate and stannous dithioacetate; dihydrocarbyltin bis(hydrocarbyl mercaptoalkanoates) such as dibutyltin bis(isoocylmercaptoacetate) and dipropyltin bis(butyl mercaptoacetate); tin thiocarbonates such as stannous O-ethyl dithiocarbonate; tin carbonates such as stannous propyl carbonate; tetrahydrocarbyltin compounds such as tetramethyltin, tetrabutyltin, tetraoctyltin, tetradodecyltin, and tetraphenyltin; dihydrocarbyltin oxides such as dipropyltin oxide; dibutyltin oxide, dioctyltin oxide, and diphenyltin oxide; dihydrocarbyltin bis(hydrocarbyl mercaptide)s such as dibutyltin bis(dodecyl mercaptide); tin salts of phenolic compounds such as stannous thiophenoxide; tin sulfonates such as stannous benzenesulfonate and stannous-p-toluenesulfonate; tin carbamates such as stannous diethylcarbamate; tin thiocarbamates such as stannous propylthiocarbamate and stannous diethyldithiocarbamate; tin phosphites such as stannous diphenyl phosphite; tin phosphates such as stannous dipropyl phosphate; tin thiophosphates such as stannous O,O-dipropyl thiophosphate, stannous O,O-dipropyl dithiophosphate and stannic O,O-dipropyl dithiophosphate, dihydrocarbyltin bis(O,O-dihydrocarbyl thiophosphate)s such as dibutyltin bis(O,O-dipropyl dithiophosphate); and the like. At present tetrabutyltin is preferred. Again, as with silicon, organic tin compounds are preferred over inorganic compounds.

Any of the listed sources of tin can be combined with any of the listed sources of silicon to form the antifoulant composition comprising tin and silicon.

The antifoulant composition can have any molar ratio of tin to silicon which suitably provides for the cracker tube treatment as required hereunder. Generally, however, the molar ratio of tin to silicon of the composition can be in the range of from about 1:100 to about 100:1. Preferably, the molar ratio can be from about 1:10 to about 10:1 and, most preferably, it can be from 1:4 to 4:1.

The antifoulant composition is utilized in the treatment of the surfaces of the radiant section cracking tubes of a cracking furnace. The antifoulant composition is contacted with surfaces of the radiant section cracking tubes either by pretreating such tubes with the antifoulant composition prior to charging the radiant section tubes with a hydrocarbon feed or by adding the composition to the hydrocarbon feed by introducing it into the crossover conduit of the cracking furnace in an amount effective for treating the tubes so as to inhibit the formation and deposition of coke thereon.

Any method can be used which suitably treats the radiant tubes of a cracking furnace by contacting such tubes with the antifoulant composition under suitable treatment conditions to thereby provide treated radiant tubes. The preferred procedure for pretreating the radiant tubes of the cracking furnace, includes charging to the inlet of the cracking furnace tubes a saturated or slightly superheated steam having a temperature in the range of from about 300° F. to about 500° F. The cracking furnace is fired while charging the convection tubes with the steam so as to provide a superheated steam which exits the radiant tubes at a temperature exceeding that of the steam introduced into the inlet of the convection tubes. Generally, the steam effluent will have a temperature upwardly to about 2000° F. The treating temperature in the radiant tubes can be in the range of from about 1000° F. to about 2000° F., preferably, from about 1100° F. to about 1800° F. and, most preferably, from 1200° F. to 1600° F.

The antifoulant composition can then be admixed with the steam being charged to the cracker tubes by introducing the antifoulant into the crossover conduit connecting the radiant section tubes and convection section tubes of the fired heater. The antifoulant composition can be admixed with the steam as either a neat liquid or as a mixture of the antifoulant composition with an inert diluent. It is preferred, however, to first vaporize either the neat liquid or the mixture of antifoulant composition and inert diluent prior to its introduction into or admixing with the steam. The amount of antifoulant composition admixed with the steam can be such as to provide a concentration of the antifoulant composition in the steam in the range of from about 1 ppmw to about 10,000 ppmw, preferably, from about 10 ppmw to about 1000 ppmw and, most preferably, from 20 to 200 ppmw.

The admixture of steam and antifoulant composition is contacted with or charged to the radiant tubes for a period of time sufficient to provide for treated radiant tubes, which when placed in cracking service, will provide for a coke formation and deposition below that which is produced with untreated radiant tubes. Such time period for pretreating the radiant tubes is influenced by the specific geometry of the cracking furnace including its tubes; but, generally, the pretreating time period can range upwardly to about 12 hours, and longer if required. But, preferably, the period of time for the pretreating can be in the range of from about 0.1 hours to about 12 hours and, most preferably, from 0.5 hours to 10 hours.

In the case where the antifoulant composition is directly admixed with the hydrocarbon cracker feed, it can be added in such an amount to be effective in inhibiting the formation and deposition of coke, but it must be introduced into the crossover conduit of the fired pyrolysis heater. Due to the memory effect resulting from the application of the antifoulant composition, mixing with the hydrocarbon cracker feed at the crossover conduit of the heater is conducted intermittently as required but, preferably, for periods up to about 12 hours. The concentration of the antifoulant composition in the hydrocarbon cracker feed during treating of the radiant tubes can be in the range of from about 1 ppmw to about 10,000 ppmw, preferably, from about 10 ppmw to about 1000 ppmw and, most preferably, from 20 to 200 ppmw.

Now referring to FIG. 1, there is illustrated by schematic representation cracking furnace section 10 of a pyrolytic cracking process system. Cracking furnace section 10 includes pyrolytic cracking means or fired heater 12 for providing heat energy required for inducing the cracking of hydrocarbons. Cracking furnace 12 defines both convection zone 14 and radiant zone 16. Respectively within such zones are convection tubes 18 and radiant tubes 20. Convection tubes 18, which are contained within convection zone 14, define a preheating zone and include a first inlet 22 and first outlet 24. Radiant tubes 20, which are contained in radiant zone 16, define a cracking zone and include a second inlet 26 and a second outlet 28. Flow communication between convection tubes 18 and radiant tubes 20 is established by crossover conduit 30 which is operatively connected to first outlet 24 and second inlet 26.

A hydrocarbon feedstock or a mixture of steam and such hydrocarbon feedstock is conducted to first inlet 22 of convection tubes 18 by way of conduit 32, which is in fluid flow communication with convection tubes 18. During the treatment of the tubes of fired heater 12, the antifoulant composition is introduced into radiant tubes 20 through conduit 34, which is operative connected and is in fluid flow communication with crossover conduit 30. The feed passes through convection tubes 18 of fired heater 12 wherein it is preheated by combustion gases passing through convection zone 14 and depicted by arrows 36*a* and 36*b*.

The preheated feed passes from convection tubes 18 through crossover conduit 30 to radiant tubes 20 wherein the preheated feed is heated to a cracking temperature such that cracking is induced or, when the tubes are undergoing treatment, to the required temperature for treatment of radiant tubes 20. The effluent from cracking furnace 12 passes downstream through conduit 38 where it is processed to remove light ends such as hydrogen and methane and where the olefins are recovered. To provide for the heat energy necessary to operate fired heater 12, fuel gas or fuel oil is conveyed through conduit 40 to burners 42 of cracking furnace 12 whereby the fuel is burned and heat energy is released.

During the treatment of radiant tubes 20, the antifoulant composition is conveyed to crossover conduit 30 through conduit 34 whereby it is contacted with radiant tubes 20. Interposed in conduit 30 is heat exchanger 44, which provides heat exchange means for transferring heat energy and to thereby vaporize the antifoulant composition.

The following example is provided to further illustrate the present invention.

EXAMPLE

A 1.3 inch I.D. Incoloy 800 tube was treated with 100 ppmm tetrabutyl tin for a period of four hours between temperatures of 1000 to 1500° F. Injection of the antifoulant was in the convection zone of the experimental furnace (temp.=400° F.). Ethane was then charged to the experimental unit at a rate of 17.0 kg/hr with a steam to hydrocarbon ratio of 0.3. Ethane conversion to ethylene was held constant at 65%. Pressure drop and carbon monoxide production, which are measures of coking in the furnace, were monitored throughout the run. Selected data are presented in Table 1.

The same tube was also treated with 100 ppmm tetrabutyl tin for a period of five hours between the temperatures of 1000 and 1500° F. with antifoulant being injected at the crossover conduit of the furnace. Pressure drop and carbon monoxide production were monitored throughout the run. Selected data are presented in Table 1. An analysis of the data presented in Table 1 shows that the injection of antifoulant in the crossover conduit as opposed to at the convection zone results in reduced pressure drop and carbon monoxide production.

TABLE 1

Comparative Test Data for Convection Zone Injection (Run A) versus Crossover Injection (Run B)

| | Pressure Drop (psi) | | CO (wt%) | |
|---|---|---|---|---|
| Runtime (hrs) | Run A | Run B | Run A | Run B |
| 0. | 0.2 | 0.2 | | |
| 5 | 0.4 | 0.3 | 0.3 | 0.06 |
| 10 | 1.1 | 0.3 | 0.55 | 0.12 |
| 15 | 3.3 | 0.4 | 0.22 | 0.12 |
| 20 | 16.8 | 0.5 | 0.16 | 0.12 |

Reasonable variations and modifications are possible by those skilled in the art within the scope of the described invention and the appended claims.

That which is claimed is:

1. A method for treating a radiant tube of a fired heater, said fired heater comprises:

a convection tube which defines a preheating zone, said convection tube is contained within a convection zone defined by said fired heater and said convection tube includes a first inlet and a first outlet;

said radiant tube which defines a cracking zone, said radiant tube is contained within a radiant zone defined by said fired heater and said radiant tube includes a second inlet and a second outlet; and crossover conduit means operatively connected to said first outlet and to said second inlet and which is in fluid flow communication with said convection tube and said radiant tube; said method comprises the steps of:

(a) introducing an antifoulant comprising tin and silicon into said crossover conduit means; and (b) contacting said radiant tube with said antifoulant under conditions suitable for the treatment of said radiant tube.

2. A method as recited in claim 1, further comprising: introducing a diluent fluid into said cracking zone simultaneously with introduction step (a).

3. A method recited in claim 2 wherein said conditions suitable for the treatment of said radiant tube include a temperature within the radiant zone between 1500° F. and 2500° F. and a pressure within the radiant zone between 0 psig to 100 psig.

4. A method as recited in claim 3 wherein the amount of said antifoulant introduced into said crossover conduit means is such that the concentration of said antifoulant in said diluent fluid is in the range of from about 1 ppmw to about 10,000 ppmw.

5. A method as recited in claim 4 wherein said diluent fluid is steam.

6. A method as recited in claim 5 wherein the molar ratio of tin to silicon in said antifoulant is in the range of from about 1:100 to about 100:1.

7. A method as recited in claim 6 wherein said antifoulant comprises tetrabutyltin and hexamethyldisiloxane.

8. A method for treating a radiant tube of a fired heater, said fired heater comprises:

a convection tube which defines a preheating zone, said convection tube is contained within a convection zone defined by said fired heater and said convection tube includes a first inlet and a first outlet;

said radiant tube which defines a cracking zone, said radiant tube is contained within a radiant zone defined by said fired heater and said radiant tube includes a second inlet and a second outlet; and crossover conduit means operatively connected to said first outlet and to said second inlet and which is in fluid flow communication with said convection tube and said radiant tube; said method comprises the steps of:

(a) introducing an antifoulant comprising tin into said crossover conduit means; and (b) contacting said radiant tube with said antifoulant under conditions suitable for the treatment of said radiant tube.

9. A method as recited in claim 8, further comprising:

introducing a diluent fluid into said cracking zone simultaneously with introduction step (a).

10. A method recited in claim 9 wherein said conditions suitable for the treatment of said radiant tube include a temperature within the radiant zone between 1500° F. and 2500° F. and a pressure within the radiant zone between 0 psig to 100 psig.

11. A method as recited in claim 10 wherein the amount of said antifoulant introduced into said crossover conduit means is such that the concentration of said antifoulant in said diluent fluid is in the range of from about 1 ppmw to about 10,000 ppmw.

12. A method as recited in claim 11 wherein said diluent fluid is steam.

13. A method as recited in claim 12 wherein said antifoulant comprises tetrabutyltin.

* * * * *